US006997747B1

(12) United States Patent
Norte et al.

(10) Patent No.: US 6,997,747 B1
(45) Date of Patent: Feb. 14, 2006

(54) SHIELD FOR HIGH FREQUENCY TELECOMMUNICATIONS CONNECTOR

(75) Inventors: David A. Norte, Westminster, CO (US); Woong K. Yoon, Westminster, CO (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 10/713,639

(22) Filed: Nov. 13, 2003

(51) Int. Cl.
*H01R 13/648* (2006.01)

(52) U.S. Cl. ..... 439/607; 439/610; 439/939; 439/545

(58) Field of Classification Search ..... 439/607, 439/609, 610, 939, 545
See application file for complete search history.

(56) References Cited

U.S. PATENT DOCUMENTS 5,801,597 A 9/1998 Carter et al. ..... 333/12
5,914,644 A 6/1999 Carter et al. ..... 333/12
6,305,986 B1 * 10/2001 Hwang ..... 439/610
6,364,706 B1 * 4/2002 Ando et al. ..... 439/607
6,491,530 B2 * 12/2002 Koide et al. ..... 439/92
6,533,612 B1 * 3/2003 Lee et al. ..... 439/607
6,688,915 B2 * 2/2004 Moriwake et al. ..... 439/607
6,699,075 B1 * 3/2004 Ko ..... 439/610
6,824,429 B2 * 11/2004 Hwang ..... 439/607

* cited by examiner

*Primary Examiner*—Gary Paumen
(74) *Attorney, Agent, or Firm*—Sheridan Ross P.C.

(57) ABSTRACT

An effective high frequency shielded telecommunication connector system is provided. In particular, a connector shield for covering an access aperture in a shielded enclosure is provided. The connector shield is formed from an electrically conductive material, and provides one or more cable apertures to permit one or more cables to exit the interior of a shielded enclosure. The maximum linear dimensions of any one cable aperture is limited, to eliminate or attenuate the leakage of electromagnetic radiation from an interior of the shielded enclosure. Mounting elements are provided to interconnect the connector shield to the template of the shielded cabinet, and to prevent gaps between the access aperture and its connector shield.

45 Claims, 8 Drawing Sheets

SHIELD FOR HIGH FREQUENCY TELECOMMUNICATIONS CONNECTOR

FIELD OF THE INVENTION

The present invention is directed to the control of electromagnetic emissions. In particular, the present invention is directed to providing a shield for controlling electromagnetic emissions in connection with high frequency signal lines.

BACKGROUND OF THE INVENTION

One important consideration in the design of electronic componentry is electromagnetic compatibility (EMC). In particular, electromagnetic fields resulting from noise signals within electrical circuits included in electronic equipment must be held to within acceptable limits, in order to prevent interference with the circuits of neighboring equipment. One way in which electromagnetic fields in the areas surrounding electronic componentry has been controlled is through the use of shielded cabinets. Such cabinets typically include connector blocks on or about a surface of the cabinet, or access holes to connector blocks. The resulting apertures created in the cabinet can allow magnetic/electric fields to escape from the cabinet, causing the electronic component to fail electromagnetic compatibility standards.

Electrical signal lines and associated input/output (I/O) electrical connectors used within shielded cabinets for telecommunications purposes are typically designed without the ability to shield high frequency radiated emissions. This shortcoming can contribute to noncompliance with electromagnetic compatibility (EMC) standards. In particular, the center portions of most multiple pin I/O connectors are comprised of a plastic form that is molded into the metal connector body in order to support the connector pins. In a typical I/O connector, this plastic portion can be rather large. For example, the plastic portion is often about 3 inches in length. This length allows high frequency free space magnetic/electric fields that are generated within the cabinet to leak from the cabinet. That is, existing connectors provide apertures through which magnetic/electric fields can escape from the interior of the shielded cabinet. Such leakage can cause equipment associated with multiple pin I/O connectors to interfere with other electronic equipment and/or to fail to meet electromagnetic compatibility standards.

SUMMARY OF THE INVENTION

The present invention is directed to solving these and other problems and disadvantages of the prior art. According to an embodiment of the present invention, a conductive connector shield is provided to block or attenuate the leakage of electromagnetic fields from within a shielded cabinet. In accordance with an embodiment of the present invention, the conductive shield includes a connector aperture, for receiving all or a portion of a conventional input/output (I/O) electrical connector. In accordance with a further embodiment of the present invention, the conductive shield has a perimeter that is about the same size as a mating template access aperture. The connector shield additionally includes mounting elements to facilitate interconnection of the connector shield to a shielded cabinet. In addition, the connector shield includes at least one cable aperture, to allow a cable comprising all or some of the signal lines associated with pins provided by the connector to exit an enclosure formed by the shielded cabinet and the connector shield. The at least one cable aperture includes a maximum linear dimension that is much less than the maximum linear dimension of the connector. For example, in accordance with an embodiment of the present invention, the at least one cable aperture has a maximum linear dimension that is less than or equal to one-thirtieth of the wavelength of the highest frequencies radiation of concern.

In accordance with an embodiment of the present invention, the mounting elements comprise a plurality of flanges that cooperate to interconnect the connector shield to a template or panel of the cabinet. The mounting elements may include apertures or notches for receiving fasteners. In accordance with still another embodiment of the present invention, the mounting elements comprise protrusions, to facilitate the electrical interconnection of the connector shield to the cabinet.

DETAILED DESCRIPTION

Figure 1A:
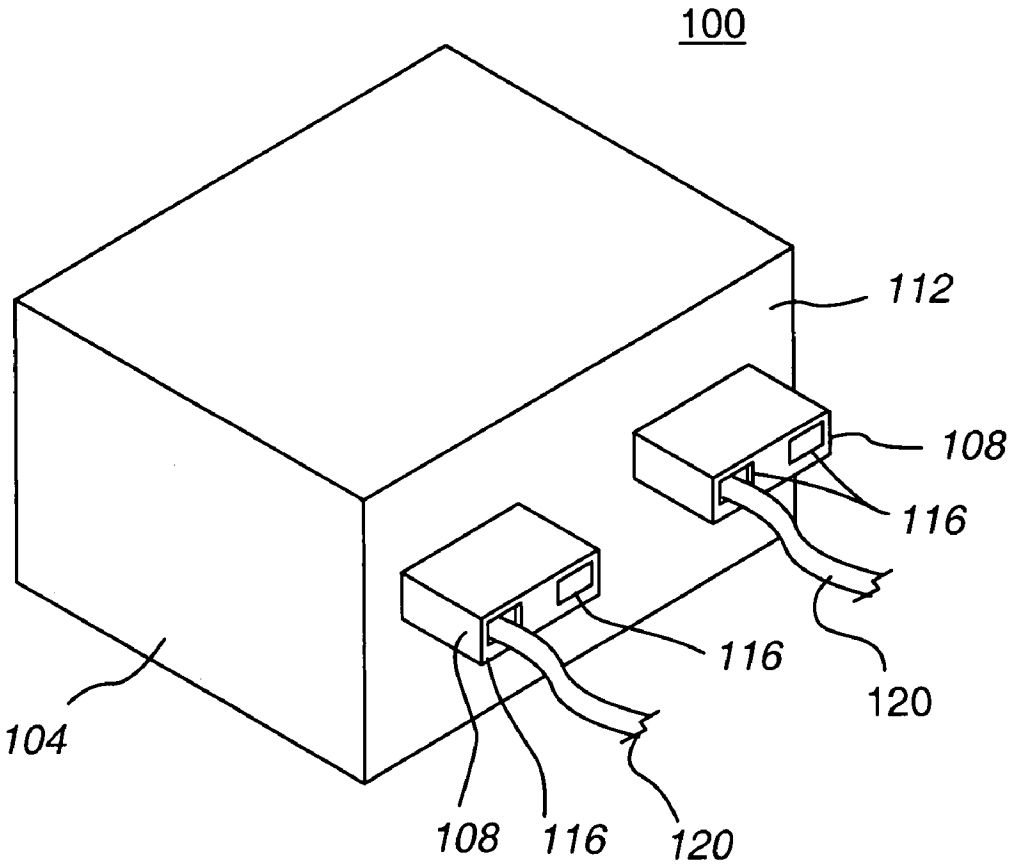
FIG. 1A illustrates a connector shield system in accordance with an embodiment of the present invention.

With reference now to FIG. 1A, a connector shield system 100 in accordance with an embodiment of the present invention is illustrated. In general, the connector shield system 100 includes a shielded cabinet 104 and one or more connector shields 108. As shown in FIG. 1A, the connector shields 108 are interconnected to a template or access panel 112 of the shielded cabinet 104. Also shown in FIG. 1A are cable apertures 116 through which a cable 120, such as a multiple conductor signal cable associated with a multiple pin connector, may exit the shielded interior volume formed by the cabinet 104 and connector shield or shields 108.

The cable apertures 116 are sized such that their maximum linear dimension is limited. The maximum permissible linear dimension of any one cable aperture 116 included as part of a connector shield 108 is determined by the maximum frequency of electromagnetic radiation that is to be attenuated or completely shielded. For example, the maximum linear dimension of any cable aperture 116 may be limited to one thirtieth of the wavelength of a signal at a frequency of concern. As a further example, in an embodiment designed to attenuate frequencies of one gigahertz or less, the maximum dimension of a cable aperture 116 is about 1 centimeter.

Figure 1B:
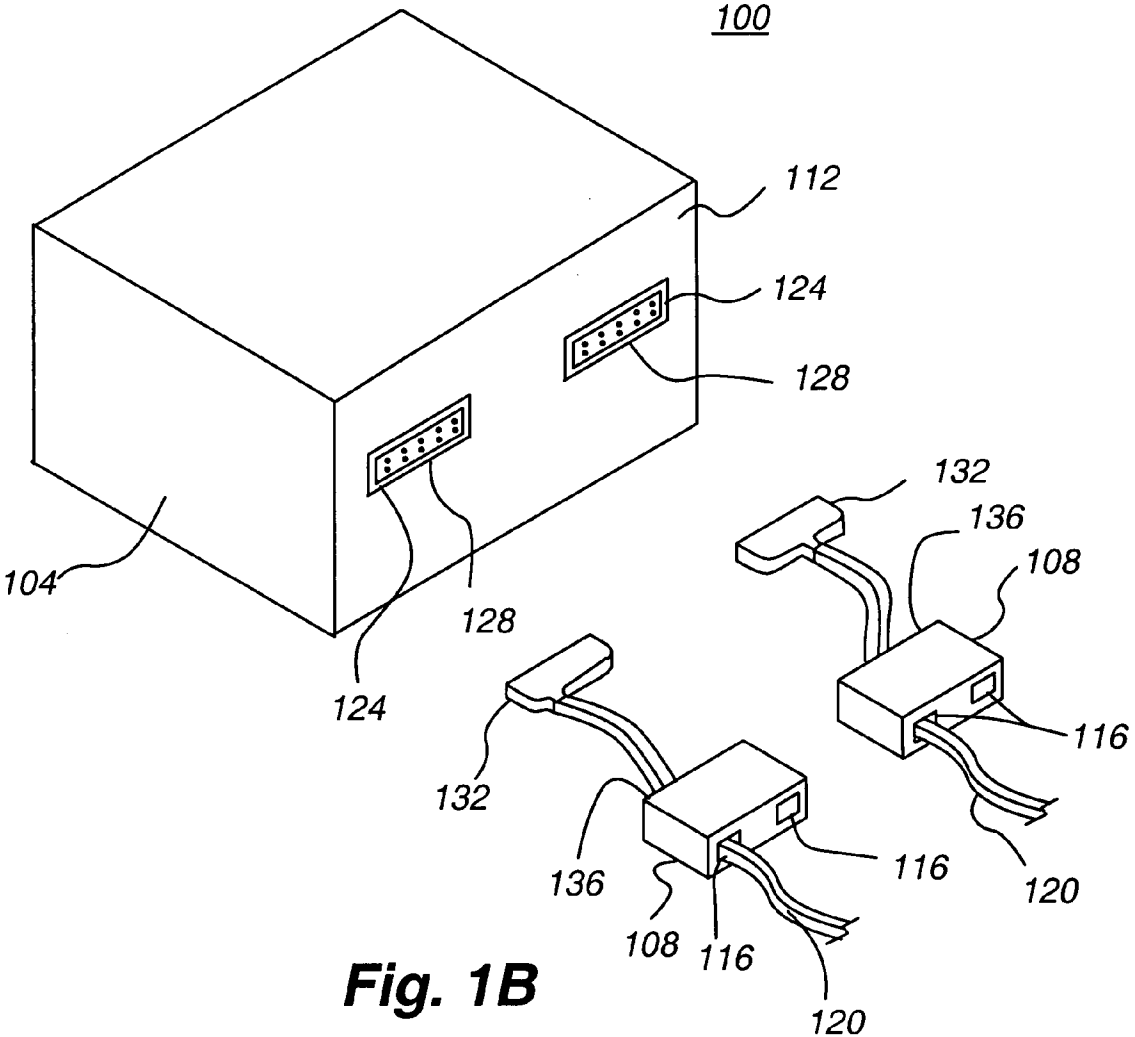
FIG. 1B is an exploded view of the connector shield system of FIG. 1A.
Figure 2A:
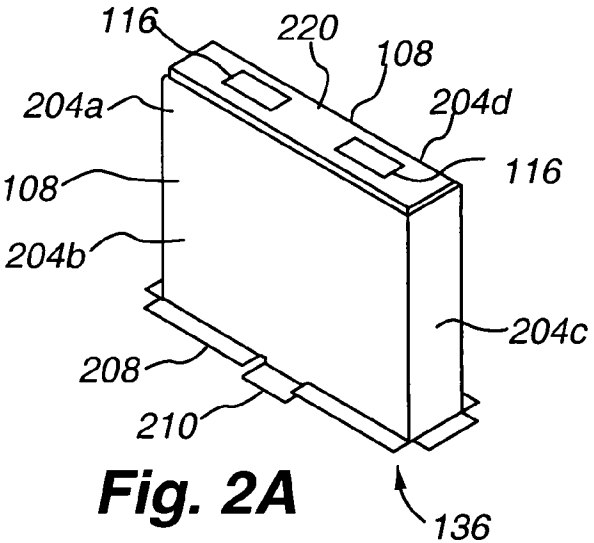
FIGS. 2A–2D are various views of a connector shield in accordance with an embodiment of the present invention.
Figure 2C:
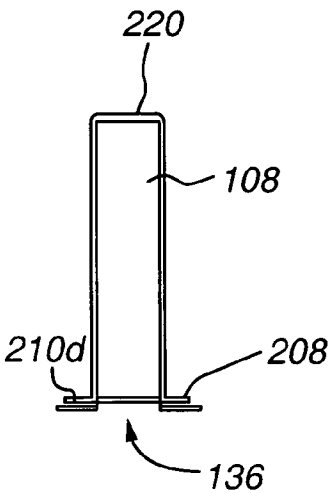
Figure 2B:
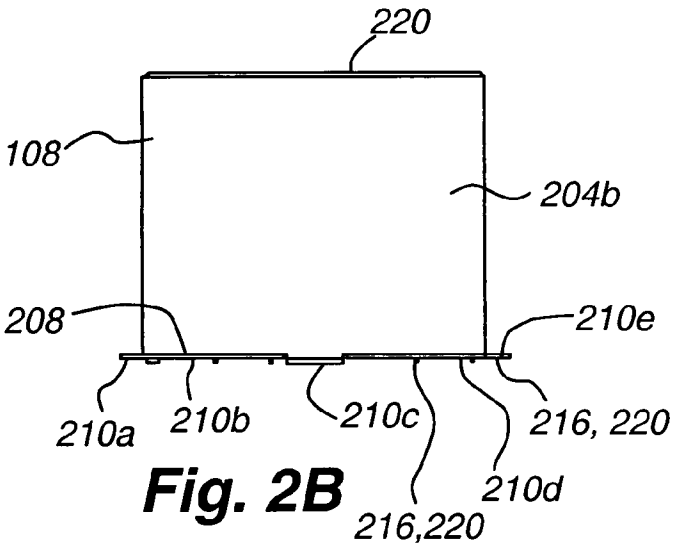
Figure 2D:
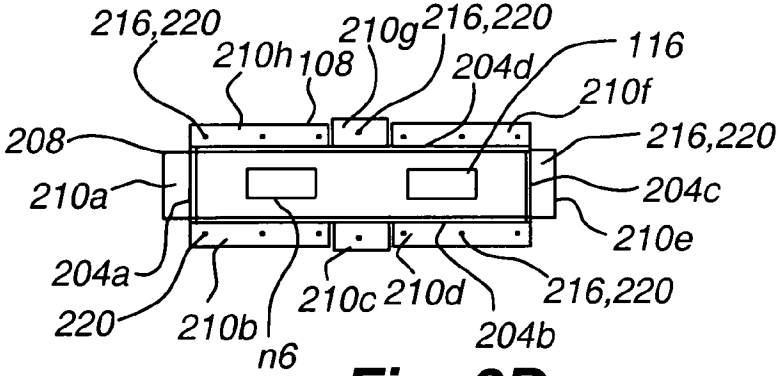
Figure 3A:
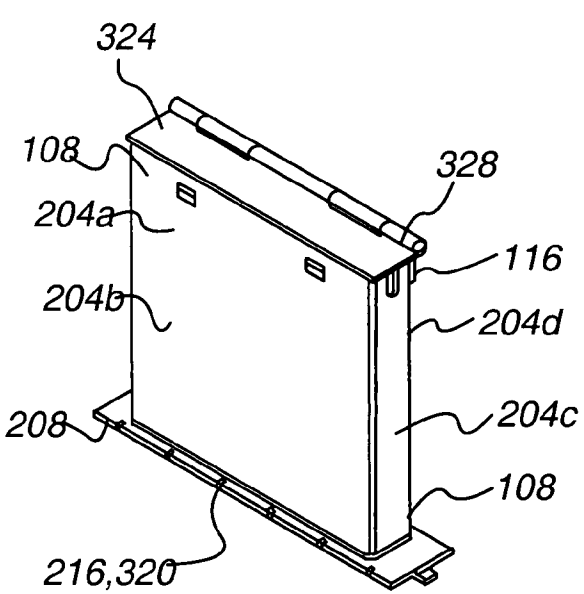
FIGS. 3A–3D are various views of a connector shield in accordance with another embodiment of the present invention.
Figure 3C:
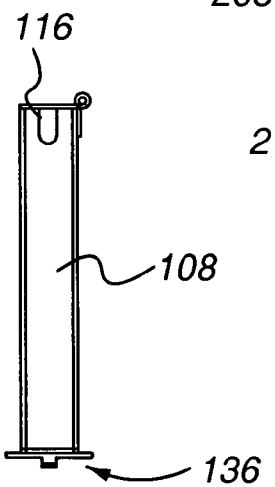
Figure 3D:
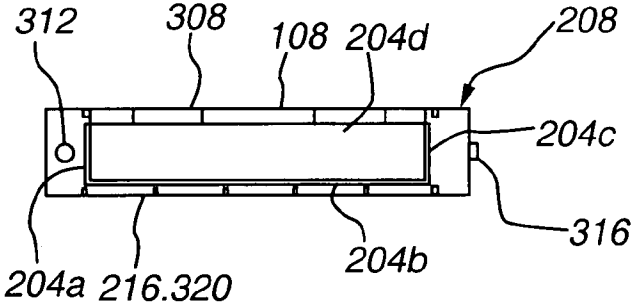
Figure 3B:
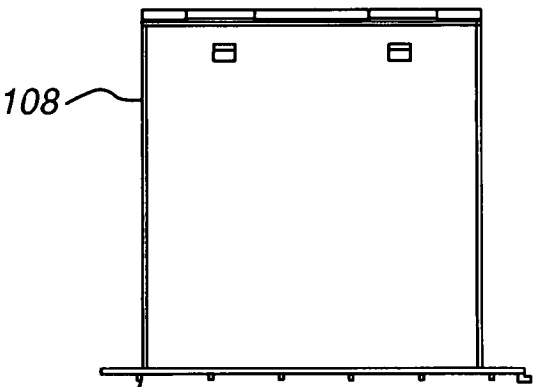
Figure 4A:
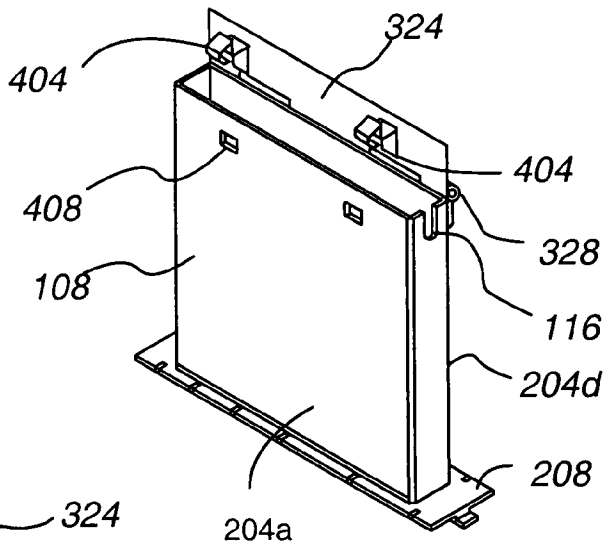
FIGS. 4A–4D are various views of the connector shield of FIGS. 3A–3D, with the cover in an open position.
Figure 4C:
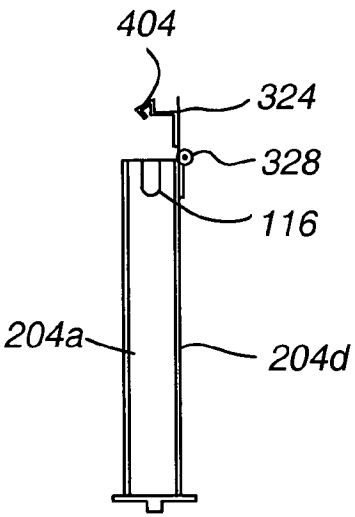
Figure 4D:
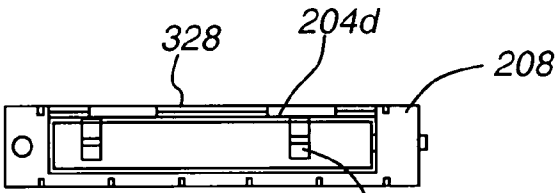
Figure 4B:
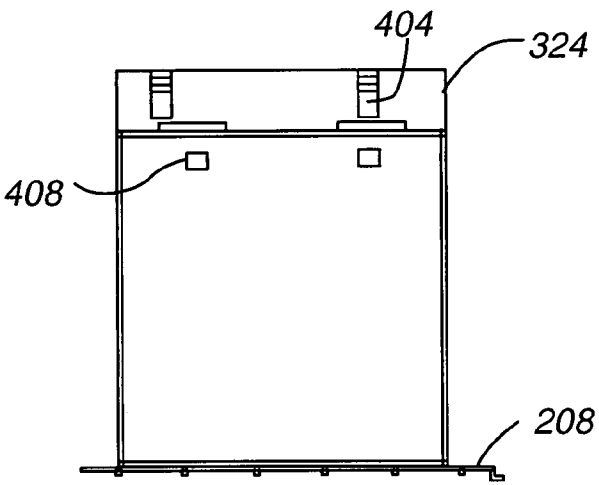
Figure 5A:
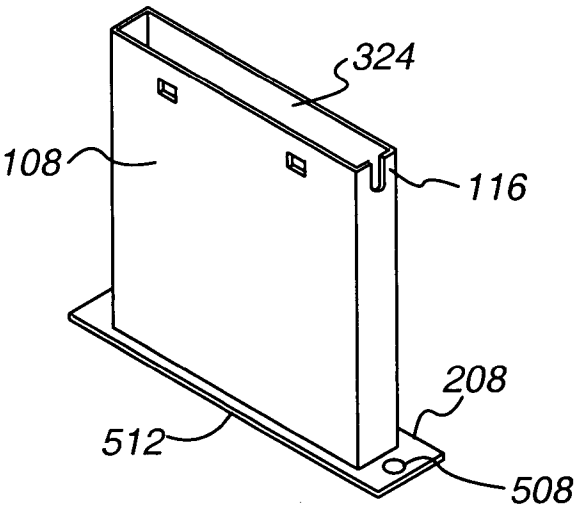
FIGS. 5A–5D are various views of a connector shield in accordance with another embodiment of the present invention.
Figure 5C:
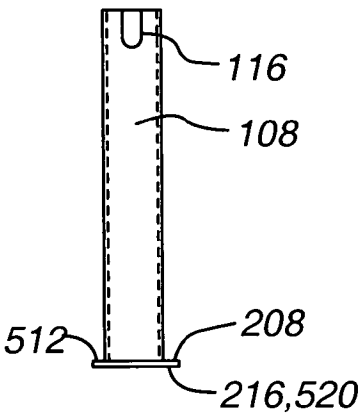
Figure 5D:
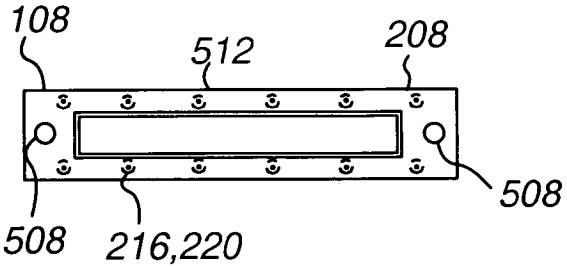
Figure 5B:
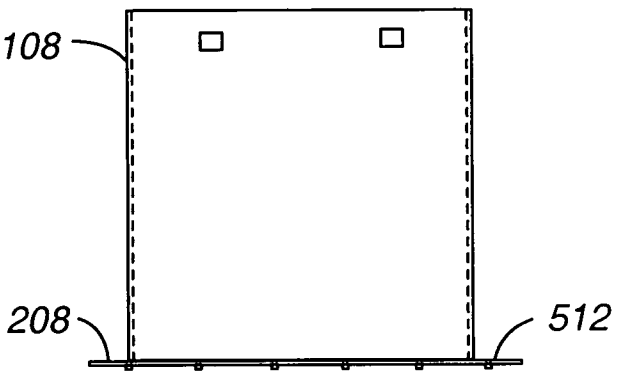
Figure 6A:
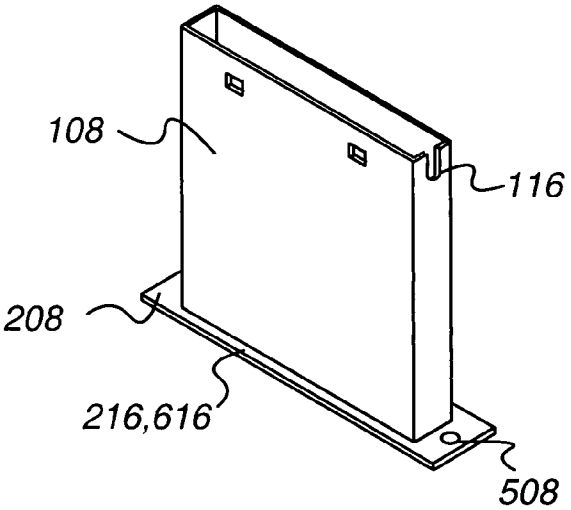
FIGS. 6A–6D are various views of a connector shield in accordance with another embodiment of the present invention.
Figure 6C:
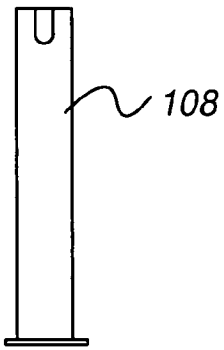
Figure 6D:
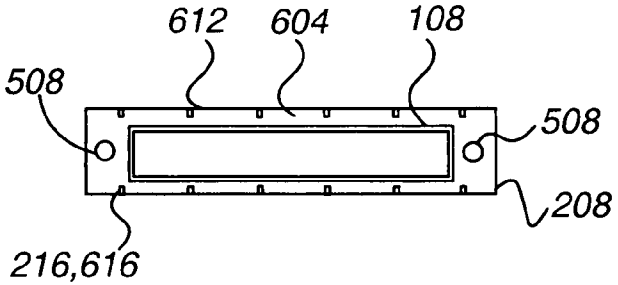
Figure 6B:
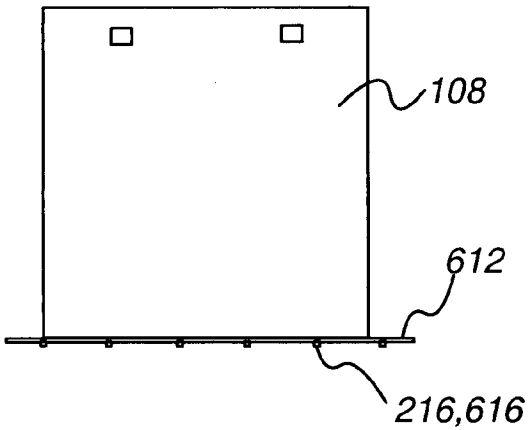
Figure 7A:
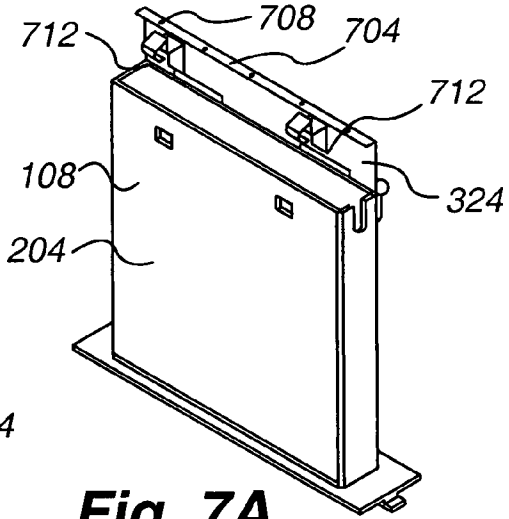
FIGS. 7A–7D are various views of a connector shield in accordance with another embodiment of the present invention.
Figure 7C:
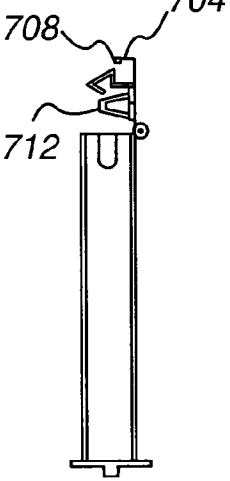
Figure 7D:
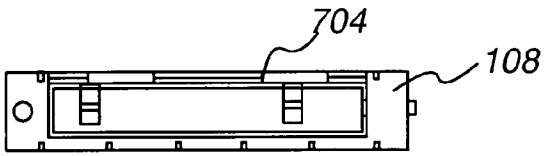
Figure 7B:
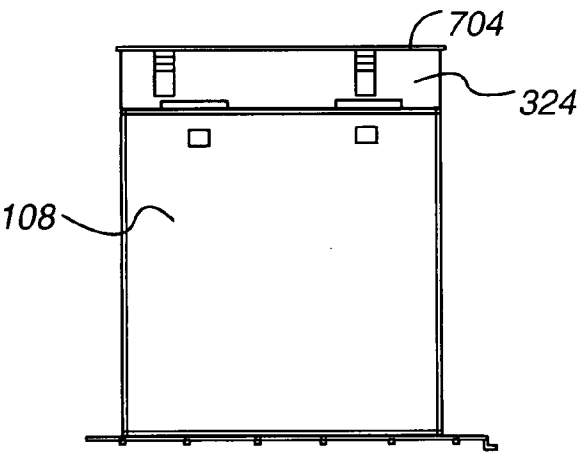

With reference now to FIG. 1B, the exemplary connector shield system 100 in accordance with the embodiments of the present invention illustrated in FIG. 1A is shown in an exploded view. In FIG. 1B, access apertures 124 formed in the template 112 of the cabinet 104 are visible. In addition, connector receptacles 128 are visible through the access apertures 124. Although in FIG. 1B the receiving connector receptacles 128 are shown as being centered within the access apertures 124, such is not necessarily the case.

Connectors 132 are associated with each of the cables 120. In general, the connectors 132 include electrical contacts, such as pins, that are sized and arranged to interconnect to mating connectors provided as part of the connector receptacles 128. As shown in FIG. 1B, the connector shields 108 may be sized such that they provide a connector aperture 136 that is large enough to receive at least a portion of an associated connector 132. In addition, the connector shield 108 may provide a volume capable of receiving all or a portion of an associated connector 132. However, this is not necessarily the case. For example, a connector shield 108 is not required to provide a volume within which all or a portion of a connector 132 is located when the shield system 100 is fully assembled. For instance, a connector 132 may be interconnected to a connector receptacle 128 that is not aligned or registered with a template aperture 124. For example, the connector receptacle 128 may be located within the volume of the cabinet 104 and at such a distance from the template aperture 124 that the connector 132 is entirely within the volume of the cabinet 104 when it is connected to the receiving connector 128. Furthermore, a connector shield 108 may also provide one or more cable apertures 116 for use in connection with a cable 120 associated with a second connector 132 that is not located within the volume of the connector shield 108 when the shield system 100 is assembled. For example, where a number of connector receptacles 128 are located within the shielded cabinet 104 more than one cable 120 may be routed through a common access aperture 124 and connector shield 108. In addition, each cable may exit the shielded volume formed by the shielded cabinet 104 and the connector shield 108 through its own cable aperture 116, or through a shared cable aperture 116.

With reference now to FIGS. 2A–2D, a connector shield 108 in accordance with an embodiment of the present invention is illustrated in various views. As seen in FIGS. 2A–2D, the connector shield 108 includes a number of substantially planar side panels 204*a–d*. Mounting elements 208*a–h* are provided around a first end of the connector shield 108. In particular, a mounting element 208 is formed about a periphery of the connector aperture 136 of the connector shield 108. In the embodiment illustrated in FIGS. 2A–2D, the mounting element 208 comprises a plurality of mounting flanges 210. The mounting flanges 210 surround the periphery of the connector aperture 136 to form a mounting element 208 that assists in covering the area of an access aperture 124 when the connector shield 108 is interconnected to a shielded cabinet 104. As can be appreciated by one of skill in the art, by thus preventing or limiting the size of any gaps between a template aperture 124 and an associated connector shield 108, the leakage of electromagnetic radiation out of the enclosure formed by the shielded cabinet 104 and connector shield or shields 108 is eliminated or attenuated. In addition, the mounting element 208 is such that the access aperture 124 and connector shield 108 do not need to be manufactured with particularly tight tolerances. Specifically, the mounting template 112 and connector shield 108 can be mass produced to relatively low tolerances, while continuing to provide effective shielding of high frequency electromagnetic radiation.

In the embodiment of FIGS. 2A–2D, at least some of the mounting flanges 210 lie in a different plane than other of the mounting flanges 210. For example, mounting flanges 210*a, b,d,e*,f and h lie in a first plane, while mounting flanges 210*c* and 210*g* lie in a second plane. This configuration facilitates interconnection of the connector shield 108 to the template 112 of the shielded cabinet 104. In particular, the mounting flanges 210 within the first plane can rest on an exterior surface of the template 112, while the mounting elements 210 located within the second plane can rest against the interior surface of the template 112.

An embodiment of a connector shield 108 in accordance with the present invention that utilizes mounting flanges as illustrated in FIGS. 2A–2D allows the connector shield 108 to be quickly and easily connected to or disconnected from the template 112 of the shielded cabinet 104. In particular, the connector shield may be connected to or disconnected from the access aperture 124 of a shielded cabinet 104 by compressing the first end of the connector shield 108 such that the mounting elements 208*c* and 208*g* in the second plane are brought towards one another, such that they can be inserted into (or removed from) the interior of the cabinet 104 through a mounting aperture 124 of the template 112. Accordingly, the connector shield 108 may be formed from a resilient, electrically conductive material.

A connector shield 108 in accordance with the embodiment of the present invention illustrated in FIGS. 2A–2D, may also include protrusions 216 provided as part of the mounting elements 208. For example, protrusions 216 may be formed in the mounting flanges 210 lying within the first plane such that they extend from the generally planar surface of those mounting flanges 210 towards the mounting flanges 210 lying within second plane. In addition, the mounting flanges 210 lying in the second plane may include protrusions 216 that extend towards the mounting flanges 210 lying in first plane. Such protrusions 216 may be formed as dimples 220 in a side of a mounting flange 210 opposite from the side from which the protrusion 216 is to extend. The provision of such protrusions 216 promotes good electrical contact between the connector shield 108 and the template 112 of the shielded cabinet 104 when the connector shield 108 is interconnected to the template 112.

The connector shield 108 illustrated in FIGS. 2A–2D additionally includes a top panel 220 in which the cable aperture or apertures 116 are formed. In general, each cable aperture 116 has a limited maximum linear dimension. By so limiting the size of the cable aperture 116, the leakage of electromagnetic radiation from the interior of the cabinet 104 can be prevented or attenuated. In accordance with an embodiment of the present invention, the maximum linear dimension of a cable aperture 116 provided as part of a connector shield 108 is one-thirtieth of the wavelength of electromagnetic energy at a frequency of concern, or less. For example, in accordance with an embodiment of the present invention, where the highest frequency of concern is about 1 GHz, the maximum linear dimension of the cable aperture 116 is 1 cm.

With reference now to FIGS. 3A–3D, a connector shield 108 in accordance with another embodiment of the present invention is illustrated. As with the embodiment described in connection with FIGS. 2A–2D, the connector shield 108 of FIGS. 3A–3D includes four generally planar side surfaces 204*a–d*. At a first end of the connector shield 108, a mounting element 208 is provided in the form of a continuous mounting flange or skirt 308 that is substantially continuous about a periphery of the connector aperture 136. In addition, the mounting element 208 of the embodiment illustrated in FIGS. 3A–3D includes a fastener aperture 312 and a mounting tab 316.

In order to interconnect the connector shield 108 of FIGS. 3A–3D to a template 112, the mounting tab 316 is placed through an access aperture 124 of the template 112 such that it contacts an interior surface of the mounting template 112. In addition, the fastener aperture 312 is aligned with a mating element associated with or formed in the template 112. For example, a threaded fastener may be passed through the aperture 312 and interconnected to a threaded hole provided as part of the template 112 to secure the connector shield 108 to the template 112. In addition, the provision of a continuous mounting flange 308 helps ensure that no gaps are formed through which electromagnetic radiation might escape the interior of the shielded cabinet 104. In addition, protrusions 216 comprising teeth 320 are formed in the continuous mounting flange 308 to promote electrical contact between the connector shield 108 and the template 112.

The connector shield 108 illustrated in FIGS. 3A–3D includes a top cover or lid member 324. As shown in FIGS. 3A–3D, the lid member 324 may be interconnected to the side panel 204*d* of the connector shield 108 by a hinge 328. This configuration facilitates the running of a cable 120 through the connector shield 108. Furthermore, the provision of a hinged top cover 324 allows cable apertures 116 to be provided that are closely matched in size to the cross sectional area of the cable 120. In particular, the provision of a hinged top cover 324 allows the cable apertures 116 to be formed as notches in one or more side panels 204, into which the cable 120 can be placed. Accordingly, the cable 120 does not need to be "fished" through the cable aperture 116.

With reference now to FIGS. 4A–4D, the embodiment of a connector shield 108 illustrated in FIGS. 3A–3D is shown with the top cover 324 in an open position. As illustrated in FIGS. 4A–4D, the top cover 324 may comprise latch members 404 that cooperate with latch apertures 408 to maintain the lid member 324 in a closed position. The latch members 404 may be formed from a resilient material.

With reference now to FIGS. 5A–5D, portions of a connector shield 108 in accordance with another embodiment of the present invention are illustrated. In particular, a connector shield 108 having a mounting element 208 comprising a plurality of mounting apertures 508 is illustrated. In connection with such an embodiment, the connector shield 108 may be interconnected to the template 112 by positioning the mounting apertures 508 adjacent cooperating mounting features on the template 112, and placing a fastener through the mounting apertures 508. In addition, the mounting element 208 comprises a mounting flange or skirt 512 to prevent leakage of electromagnetic radiation from the interior of the cabinet 104. Protrusions 216 may be provided as part of the mounting flange 512 in the form of dimples 220. A lid member 324 may be provided to complete the enclosure formed by the shielded cabinet 104 and the connector shield 108.

With reference now to FIGS. 6A–6D, a connector shield 108 in accordance with still another embodiment of the present invention is illustrated. In the embodiment shown in FIGS. 6A–6D, a mounting element 208 comprising a plurality of fastener or mounting apertures 508 are provided. In addition, a mounting flange or skirt 612 having protrusions 216 comprising teeth 616 for promoting electrical contact with the template 112 is provided.

With reference now to FIGS. 7A–7D, a connector shield in accordance with another embodiment of the present invention is illustrated. The embodiment shown in FIGS. 7A–7D includes a lid member 324 having a lip 704 that extends along an edge of the lid member 324. The lip 704 may include protrusions or teeth 708 to promote electrical contact between the lid member 324 and the corresponding side panel 204 of the connector shield 108 when the lid member 324 is in a closed position. In addition, a retention clip 712 is provided. The retention clip 712 is used to apply pressure against a connector or connector head enclosed or partially enclosed by the connector shield 108 to keep the connector engaged with its pin field.

The various connector shield 108 embodiments described herein may be formed from any electrically conductive material. For example, a connector shield may be formed from a sheet of stamped steel. Furthermore, it should be appreciated that the shape of a connector shield 108 is not limited to generally rectangular boxes. In particular, the shape of the connector shield 108 can be adapted to the shape of the template aperture 124 and/or the connector 132 the connector shield 108 is adapted to be used with. Similarly, the size, configuration and number of cable apertures 116 will generally be determined by the application. In particular, the maximum linear dimension of the cable aperture or apertures 116 can be selected based on the maximum frequency of electromagnetic radiation that is to be eliminated or attenuated. In addition, the shape and number of cable apertures 116 provided as part of a connector shield 108 can be selected based on the number of cables 120 that are to be routed through a particular connector shield 108.

Embodiments of a connector shield 108 in accordance with present invention are not limited to having either a fixed top panel 220 or a hinged top panel 324. For example, a top panel that snaps or is pressed into place may be provided. In addition, alternative cable aperture 116 arrangements can be provided, including a plurality of slots, apertures, or a combination of slots and apertures.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include the alternative embodiments to the extent permitted by the prior art.

What is claimed is:

1. A connector shield, comprising:

at least four side panels;

a connector aperture proximate to a first end of said connector shield;

a number of mounting elements proximate to a first end of said connector shield wherein at least two of said mounting elements are on opposite sides of said connector aperture, and wherein said mounting elements are operable to interconnect said connector shield to a cabinet of an electrical component;

a cable aperture proximate to a second end of said connector shield;

an interior volume defined at least in part by said four side panels, wherein electromagnetic radiation having less than a first frequency is prevented from exiting said interior volume through said cable aperture.

2. The connector shield of claim 1, wherein said mounting elements are located adjacent said connector aperture.

3. The connector shield of claim 1, wherein said mounting elements comprise mounting flanges.

4. The connector shield of claim 3, wherein said mounting flanges are located around each side of said connector aperture.

5. The connector shield of claim 1, wherein said mounting element comprises at least a first fastener aperture.

6. The connector shield of claim 3, wherein said mounting flange comprises at least a first protrusion.

7. The connector shield of claim 1, further comprising:

a plurality of cable apertures.

8. The connector shield of claim 1, wherein said cable aperture is rectangular.

9. The connector shield of claim 1, wherein said cable aperture has a maximum linear dimension of 1 cm.

10. The connector shield of claim 1, further comprising a lid member.

11. The connector shield of claim 10, wherein said cable aperture is formed in said lid member.

12. The connector shield of claim 10, wherein said lid member is interconnected to a body of said connector shield by a hinge.

13. The connector shield of claim 10, wherein said lid member includes a lip.

14. The connector shield of claim 13, wherein said lip includes at least a first protrusion.

15. The connector shield of claim 1, wherein said connector shield is formed from an electrically conductive material.

16. A connector shield, comprising:

a connector aperture;

a mounting element, wherein said mounting element is operable to interconnect said connector shield to a cabinet of an electrical component, wherein said mounting element comprises a plurality of mounting flanges, and wherein at least a first of said mounting flanges lies in a first plane and at least a second of said mounting flanges lies in a second plane;

a cable aperture; and an interior volume, wherein electromagnetic radiation having less than a first frequency is prevented from exiting said interior volume through said cable aperture.

17. A connector shield, comprising:

a connector aperture;

a cable aperture;

a lid member, wherein said lid member may be selectively placed in at least one of a closed position and an open position, wherein said lid member is interconnected to a body of said connector shield by a hinge;

an interior volume, wherein electromagnetic radiation having less than a first frequency is prevented from exiting said interior volume through said cable aperture.

18. The connector shield of claim 17, wherein said cable aperture is formed in said lid member.

19. The connector shield of claim 17, wherein said lid member includes a lip.

20. The connector shield of claim 19, wherein said lip includes at least a first protrusion.

21. The connector shield of claim 17, further comprising:

a mounting element, wherein said mounting element is operable to interconnect said connector shield to a cabinet of an electrical component.

22. The connector shield of claim 21, wherein said mounting element is located adjacent said connector aperture.

23. The connector shield of claim 21, wherein said mounting element comprises a mounting flange.

24. The connector shield of claim 23, further comprising a plurality of mounting flanges.

25. The connector shield of claim 21, wherein said mounting element comprises at least a first fastener aperture.

26. The connector shield of claim 23, wherein said mounting flange comprises at least a first protrusion.

27. The connector shield of claim 17, further comprising:

a plurality of cable apertures.

28. The connector shield of claim 17, wherein said cable aperture is rectangular.

29. The connector shield of claim 17, wherein said cable aperture has a maximum linear dimension of 1 cm.

30. The connector shield of claim 17, wherein said connector shield is formed from an electrically conductive material.

31. A connector shield, comprising:

a connector aperture;

a cable aperture;

a lid member;

an interior volume, wherein electromagnetic radiation having less than a first frequency is prevented from exiting said interior volume through said cable aperture;

a mounting element, wherein said mounting element is operable to interconnect said connector shield to a cabinet of an electrical component;

wherein said mounting element comprises a plurality of mounting flanges; and wherein at least a first of said mounting flanges lies in a first plane and at least a second of said mounting flanges lies in a second plane.

32. The connector shield of claim 31, wherein said cable aperture is formed in said lid member.

33. The connector shield of claim 31, wherein said lid member is interconnected to a body of said connector shield by a hinge.

34. The connector shield of claim 31, wherein said lid member includes a lip.

35. The connector shield of claim 34, wherein said lip includes at least a first protrusion.

36. The connector shield of claim 31, wherein said mounting flanges are located adjacent said connector aperture.

37. The connector shield of claim 31, wherein said mounting flanges comprise at least a first fastener aperture.

38. The connector shield of claim 31, wherein said mounting flanges each comprise at least a first protrusion.

39. The connector shield of claim 31, further comprising:

a plurality of cable apertures.

40. The connector shield of claim 31, wherein said cable aperture is rectangular.

41. The connector shield of claim 31, wherein said cable aperture has a maximum linear dimension of 1 cm.

42. The connector shield of claim 31, wherein said connector shield is formed from an electrically conductive material.

43. A multiple pin connector shield system, comprising:

means for enclosing electronic componentry capable of at least one of receiving and transmitting electrical signals, wherein said means for enclosing electronic componentry defines an interior volume, and;

shield means for preventing electromagnetic radiation having no more than a first frequency from passing through said shield means into an environment surrounding said means for enclosing, wherein substantially all of said shield means is outside of said interior volume of said means for enclosing electronic componentry, and wherein said shield means includes:

means for interconnecting said shield means to said means for enclosing electronic componentry;

means for allowing a multiple conductor cable to exit said shield means, wherein said means for allowing a multiple conductor cable to exit said shield means does not allow electromagnetic radiation having less than a first frequency to exit said shield means, wherein said means for enclosing electronic componentry includes access panel means with an access aperture formed therein, and wherein said shield means substantially covers said access aperture.

44. The system of claim 43, wherein said first frequency is greater than 1 GHz.

45. The system of claim 43, further comprising:

means for promoting electrical contact between said shield means and said means for enclosing electronic componentry.

* * * * *